US012630978B2

(12) United States Patent
Leandersson et al.

(10) Patent No.: US 12,630,978 B2
(45) Date of Patent: May 19, 2026

(54) METHOD FOR MANUFACTURING A SUPPORT BODY ARRANGEMENT, AND A SUPPORT BODY ARRANGEMENT

(71) Applicant: VALMET AB, Sundsvall (SE)

(72) Inventors: Anders Leandersson, Karlstad (SE); Jonas Berg, Hammarö (SE); Anders Brattström, Karlstad (SE); Peter Järkeborn, Karlstad (SE); Adam Nordin, Karlstad (SE)

(73) Assignee: VALMET AB, Sundsvall (SE)

( * ) Notice: Subject to any disclaimer, the term of this patent is extended or adjusted under 35 U.S.C. 154(b) by 272 days.

(21) Appl. No.: 18/253,443

(22) PCT Filed: Nov. 23, 2021

(86) PCT No.: PCT/EP2021/082582
§ 371 (c)(1),
(2) Date: May 18, 2023

(87) PCT Pub. No.: WO2022/122369
PCT Pub. Date: Jun. 16, 2022

(65) Prior Publication Data

US 2024/0052569 A1 Feb. 15, 2024

(30) Foreign Application Priority Data

Dec. 7, 2020 (SE) ..... 2051422-0

(51) Int. Cl.
*D21F 3/02* (2006.01)

(52) U.S. Cl.
CPC ..... *D21F 3/0218* (2013.01)

(58) Field of Classification Search
CPC ..... D21F 3/0218
(Continued)

(56) References Cited

U.S. PATENT DOCUMENTS 4,576,682 A 3/1986 Laapotti
5,011,578 A * 4/1991 Lange ..... D21F 3/0245 100/153
(Continued)

FOREIGN PATENT DOCUMENTS

EP 0933471 A2 8/1999
EP 2013412 A1 1/2009
(Continued)

OTHER PUBLICATIONS

Japanese Office Action for Japanese Application No. 2023-534370, dated May 28, 2024, 10 pages.
(Continued)

*Primary Examiner* — Jacob T Minskey
(74) *Attorney, Agent, or Firm* — Alston & Bird LLP

(57) ABSTRACT

The present invention relates to a method for manufacturing a support body arrangement for an apparatus having an extended nip formed between the support body and a counter-pressure member, wherein the method comprises: providing a base body (51) comprising at least one pressure chamber configured to be pressurized for controlled expanding of the base body in a first direction; providing a support body (52) comprising a working surface (15) for forming an extended nip with a counter-pressure member; providing a mounting structure (53); mounting the support body (52) on the base body (51) by applying the mounting structure (53) so that movement of the support body (52) in relation to the base body (51) is prevented, wherein the support body (52) is placed on the base body (51) so that the working surface (15) faces away from the base body (51). The invention also relates to a support body arrangement.

27 Claims, 10 Drawing Sheets

Figure 1:
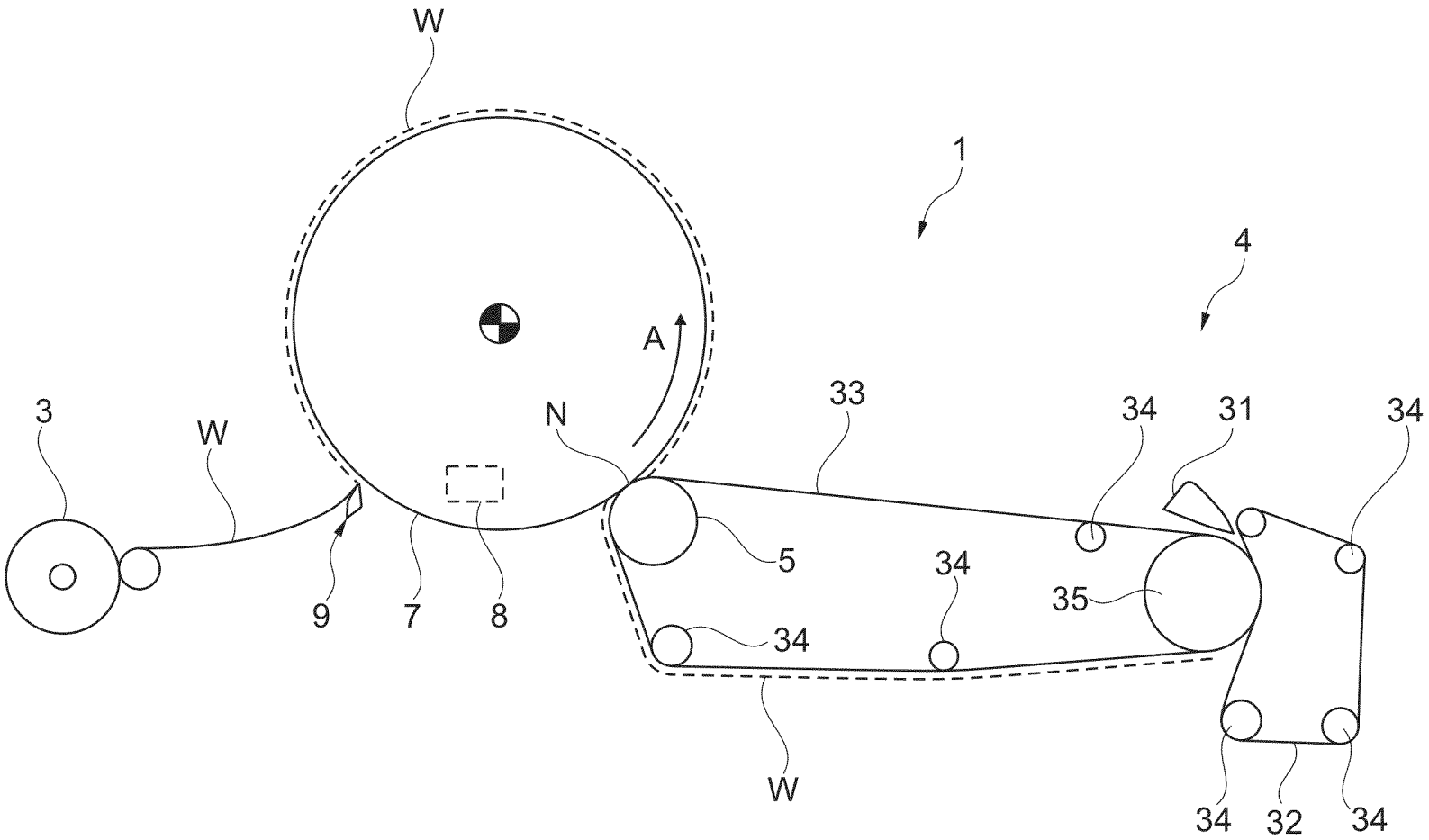

(58) Field of Classification Search
USPC ..... 162/358.2
See application file for complete search history.

(56) References Cited

U.S. PATENT DOCUMENTS

| | | | | |
|---|---|---|---|---|
| 9,181,655 | B2 | 11/2015 | Gustavsson et al. | |
| 2003/0024405 | A1 | 2/2003 | Brendel et al. | |
| 2009/0173465 | A1 | 7/2009 | Gustavsson | |
| 2015/0060000 | A1* | 3/2015 | Gustavsson ..... | D21F 3/0218 162/358.3 |
| 2016/0108579 | A1 | 4/2016 | Meitner et al. | |

FOREIGN PATENT DOCUMENTS

| | | | |
|---|---|---|---|
| EP | 2808442 | A1 | 12/2014 |
| JP | H11279976 | A | 10/1999 |
| JP | 2003049379 | A | 2/2003 |
| JP | 2015519484 | A | 7/2015 |

OTHER PUBLICATIONS

International Search Report and Written Opinion for International Application No. PCT/EP2021/082582, dated Mar. 1, 2022, (11 pages), European Patent Office, Rijswijk, Netherlands.

* cited by examiner

METHOD FOR MANUFACTURING A SUPPORT BODY ARRANGEMENT, AND A SUPPORT BODY ARRANGEMENT

CROSS REFERENCE TO RELATED APPLICATIONS

This application is a National Stage Application, filed under 35 U.S.C. § 371, of International Application No. PCT/EP2021/082582, filed Nov. 23, 2021, which international application claims priority to and the benefit of Swedish Application No. 2051422-0, filed Dec. 7, 2020; the contents of both of which as are hereby incorporated by reference in their respective entireties.

TECHNICAL FIELD

The present invention relates to a method for manufacturing a support body arrangement for an apparatus having an extended nip formed between the support body and a counter-pressure member. The invention also relates to a support body arrangement and a support body for a support body arrangement. The apparatus having an extended nip is suitably a paper machine.

BACKGROUND

In a paper making machine, an extended nip press is generally used for pressing water out of a newly formed wet fibrous web but an extended nip may also be used for other purposes in a paper making machine, e.g. calendering. Although extended nip presses were first introduced for heavy grades such as paperboard, they have also come to be used for lighter grades such as printing paper and even for tissue paper. When making tissue paper, the extended nip press is often formed by an extended nip roll and a Yankee drying cylinder that acts as a counter roll for the extended nip roll.

An extended nip press, especially in a machine for making tissue paper, is typically formed by an extended nip roll that comprises a support body with a working surface that is pressed against the counter roll by pressurized chambers inside or below the show acting to push the support body in a first direction towards the counter roll.

Within the art, rigid shoes typically made from metallic materials are known but it is especially advantageous to use softer, more flexible support bodies that are elastically deformable in order to adjust the extended nip as desired and achieve a suitable pressure profile.

Although support bodies of the flexible type are known, for instance through U.S. Pat. No. 9,181,655 and EP 2013412, manufacturing them is generally complicated and involves a multi-step process using a plurality of materials having different properties and requiring careful monitoring in order to form the support body as desired. Also, replacing the support body after prolonged use requires interruption of operation of the paper machine and costly replacements. The time needed to repair and/or replace the support body is especially costly, since it requires the paper machine to be idle.

There is therefore a need for improvements within this area.

SUMMARY

The object of the present invention is to eliminate or at least to minimize the problems discussed above. This is achieved by a support body arrangement, a method for manufacturing a support body arrangement, a support body and a method for replacing a support body of a support body arrangement according to the appended independent claims.

The method according to the present invention relates to manufacturing a support body arrangement for an apparatus having an extended nip formed between the support body and a counter-pressure member, and the method comprises

- providing a base body comprising at least one pressure chamber configured to be pressurized for controlled expanding of the base body in a first direction,
- providing a support body comprising a working surface for forming an extended nip with a counter-pressure member,
- providing a mounting structure,
- mounting the support body on the base body by applying the mounting structure so that movement of the support body in relation to the base body is prevented, wherein the support body is mounted on the base body so that the working surface faces away from the base body.

By providing the base body separately from the support body, each of these bodies may be manufactured in separate processes and be mounted together using the mounting structure so that the support body arrangement is formed.

This provides a significant advantage over known prior art solutions, since manufacture of the base body and of the support body in separate processes is easier and more efficient than joining them together in the known complex manufacturing processes. By providing the mounting structure, the support body arrangement may be manufactured through a combination of existing components as desired, even on site near a paper machine that needs replacing of the support body arrangement for the extended nip press. The manufacturing method according to the invention is more robust than the prior art methods and allows for combinations of different designs of the base body and the support body with only minor modifications to the overall manufacturing method.

Suitably, the mounting structure comprises an adhesive and the mounting of the support body on the base body comprises applying the adhesive to at least one of the base body and the support body and bringing the base body and the support body into contact with each other with the adhesive between them. Thereby, the support body is fixed to the base body by means of the adhesive and movement of the support body in relation to the base body is prevented. This is an easy and convenient way of mounting the support body arrangement. It is also especially to be noted that the mounting structure may comprise other fastening means that are combined with the adhesive in order to achieve an especially secure fastening.

The mounting structure may also comprise a first portion that is fixedly attached to the support body and a second portion that is fixedly attached to the base body. The mounting of the support body on the base body then comprises bringing the first portion and the second portion into engagement with each other. Thereby, the support body may be mounted on the base body in an easy and reliable way. By the first portion and the second portion already being fastened to the support body and the base body, respectively, the mounting structure is able to achieve a time efficient and stable mounting of the support body arrangement. In some embodiments, the first portion and/or the second portion may be fixedly attached by being molded into the support body and/or the base body, but in other embodiments at least one of the first and the second portion may be fastened by other means such as being screwed or clamped to the support body or the base body.

Alternatively, the mounting structure comprises at least two side portions that are configured to extend from the base body in the first direction at a distance from each other. The mounting of the support body on the base body then comprises inserting the support body between the at least two side portions to rest on the base body. Thereby, the support body may be held in place by friction against the at least two side portions in order to provide a time efficient and reliable mounting of the support body arrangement. In some embodiments, the at least two side portions are present only on ends of the base body in a direction transversal to a direction in which a web or paper travels during use of the support body arrangement. In other embodiments, the at least two side portions can instead be arranged to partly or entirely enclose the support body so that only the working surface is left uncovered. The number of side portions and their distribution may thus be varied depending on factors such as properties of the paper machine where the extended nip press it mounted and/or depending on properties of the support body and/or base body as desired.

Suitably, the mounting structure may comprise a separate mounting body with a base body engagement part and a support body engagement part, so that the mounting of the support body on the base body comprises bringing the base body into engagement with the base body engagement part and the support body into engagement with the support body engagement part in order to fixate them in relation to each other. Thereby, the mounting structure may be provided as a separate component and be combined with the base body and the support body during mounting. This is especially beneficial since the base body and the support body may be manufactured separately without being adapted to fit each other as long as the mounting structure is able to interact with them both. Also, in some applications it is advantageous to avoid the presence of parts of the mounting structure in the base body and/or the support body since the support body especially may then be designed and manufactured to have properties that are optimal for a particular paper machine or field of use without having to consider how the mounting structure could affect such properties.

Suitably, the mounting structure may be disengaged in order to remove the support body from the base body. This is especially beneficial in allowing for the support body to be releasably arranged so that a damaged and/or worn support body may be replaced. Also, for situations where the paper machine is switched from one set of operation parameters to another it becomes possible to remove and replace the support body in the support body arrangement on site so that the same base body may be used with the new operation parameters. Conversely, it is possible to replace a damaged or worn base body while retaining the support body due to the mounting structure being able to disengage.

The present invention also comprises a support body arrangement for an apparatus having an extended nip formed between the support body arrangement and a counter-pressure member, wherein the support body arrangement comprises

- a base body having at least one pressure chamber configured to be pressurized for controlled expanding of the base body in a first direction,
- a support body having a working surface for forming an extended nip with a counter-pressure member, wherein the support body is arranged on the base body so that the working surface faces in the first direction, and
- a mounting structure that is configured to engage with the support body and with the base body in order to fixate them in relation to each other.

This provides the significant advantages of allowing for the base body and the support body being manufactured independently of each other and forming the support body arrangement by the mounting structure being provided for engaging with them and fixating them. As mentioned above, this is advantageous both in allowing for different manufacturing processes and possibly different manufacturing sites for the base body and the support body before they are mounted and also in allowing for mounting the support body arrangement on location where it is to be used in a paper machine. The handling and use of the support body arrangement is rendered more versatile and cost efficient in this way.

Suitably, the mounting structure comprises an adhesive arranged on a surface of the base body and/or on a surface of the support body such that the base body and the support body adhere to each other.

Also, the mounting structure may comprise a first portion that is fixedly attached to the support body and a second portion that is fixedly attached to the base body, wherein further the first portion and the second portion of the mounting structure are configured to engage with each other in a mounted state for mounting the support body on the base body.

Suitably, the first portion may be integrated with the support body and/or the second portion is integrated with the base body. This is beneficial in preventing undesired removal of the first portion and/or second portion and provides a secure and reliable mounting of the support body arrangement.

Also, one of the first portion and the second portion may comprise a male part and the other of the first portion and the second portion may comprise a female part, and furthermore the male and female parts are configured to mate with each other such that the support body is mounted on the base body. Thereby, a secure mounting fixating the support body in relation to the base body is achieved.

Also, one of the first portion and the second portion may comprise an inner thread and the other of the first portion and the second portion may comprise an outer thread. The inner thread and outer thread are then configured to cooperate such that the support body is mounted on the base body. This enables a stable and secure mounting so that accidental removal of the support body from the base body is prevented.

Alternatively, one of the first portion and the second portion may comprise a pin and the other of the first portion and the second portion may comprise a receiving opening for receiving the pin such that the support body is mounted on the base body. Thereby, a stable and secure mounting is also achieved.

Also, the mounting structure may comprise a gripping member that is fixedly attached to the base body, the gripping member being configured to enclose at least a part of the support body such that the support body is mounted on the base body. This allows for the support body to be applied to the base body and be held securely. In one embodiment, the gripping member may be in the form of at least two side portions that are configured to extend from the base body in the first direction at a distance from each other, so that the support body is configured to be inserted between the at least two side portions in order to mount support body on the base body. The at least two side portions may be provided as opposite side portions arranged transversally on the base body, but alternatively the side portions are arranged to enclose the support body on both transversal and longitudinal sides.

Suitably, the mounting structure may be a separate mounting body comprising a base body engagement part configured to engage with the base body and a support body engagement part configured to engage with the support body for mounting the support body on the base body. This allows for the manufacture of the support body and the base body independently of each other and is especially beneficial since the mounting structure does not risk interfering with properties of the base body or support body during manufacture. Thus, the support body and the base body may be made without having to take the mounting structure into account as long as the mounting structure is able to then mount the support body on the base body.

Suitably, the mounting structure is configured to be releasably mounted such that the support body can be removed from the base body. This allows for the removal and replacement of the support body and/or the base body as desired when worn or damaged.

Also, the support body may comprise a first material, said first material being a material that has a shore A hardness of 95 or less. Thereby, an elastically deformable support body is achieved so that the elongated nip may be realized as desired.

Suitably, the base body comprises a second material that has a shore A hardness of 90 or less. Thereby, a suitably elastic base is achieved so that the base body may be expanded and the support body continuously pressed in the first direction in order to achieve desired properties of the elongated nip.

Advantageously, the support body may be harder than the base body, i.e. have a shore A hardness of the support body that is larger than a shore A hardness of the base body. This is advantageous in allowing the base body to expand while at the same time providing a suitable pressing of the working surface into the extended nip.

In some embodiments, the support body and the base body comprise different materials. Thereby a stable and reliable base body may be combined with a flexible and elastic support body in order to achieve the benefits of having an elastic body in the elongated nip while at the same time having a flexible base body to allow extension of the base body as desired. It is also highly beneficial to be able to manufacture the support body separately from the base body, since the combination of different materials when manufacturing one combined base body/support body component is associated with considerable difficulty and requires careful control of the manufacture. To be able to achieve the benefits of both materials without having to take them into account when manufacturing the base body and the support body is therefore one of the main benefits of the present invention.

In some embodiments the support body and the base body may comprise the same material. This may then be a material that is provided in an elastically deformable and a non-elastic variety so that the desired flexibility of the base body and the desired more stable support body may be achieved. Alternatively, the support body and the base body may have similar properties or differ very little from each other. One material that is suitable for these purposes is polyurethane, which may be adapted to have desired properties regarding stiffness and elasticity, so that both more flexible bodies and more stable ones may be made from the same material but have different hardness. The manufacture of the base body separately from the support body is again highly beneficial since there are considerable difficulties associated with manufacturing one combined base/support body component using different versions of the same material.

Suitably, at least one of the base body and the support body comprises a polymer. Thereby, materials that have desired properties to serve as a support body and/or base body may be used.

In some embodiments the base body comprises a base section having the at least one pressure chamber and a top section that is arranged on the base section in the first direction, wherein the top section is preferably releasably attached to the base section. This provides the base body as a combination of two different sections that may also be manufactured separately from each other and that may be mounted to form the base body before applying the mounting structure to mount the support body, or that may alternatively be mounted by using the mounting structure for this purpose also.

The present invention also refers to a method for replacing a support body of a support body arrangement according to the invention in a paper machine having an extended nip formed between the support body and a counter-pressure member. This method comprises disengaging the mounting structure of the support body arrangement, removing the support body from the base body, providing an additional support body that comprises a working surface for forming an extended nip with a counter-pressure member of the apparatus, and mounting the additional body on the base body of the support body arrangement by engaging the mounting structure. Thereby, a support body may be replaced when damaged or worn. This enables a shorter downtime for maintenance and repair since replacing the support body may take place on site, and it also provides a cost-efficient support body arrangement since parts that are still in good working order may be retained.

Suitably, this method also comprises replacing at least part of the mounting structure before mounting the additional support body on the base body. This is advantageous since the mounting structure may itself be damaged or worn. Also, if the mounting structure comprises an adhesive, a used adhesive may be removed and replaced with fresh adhesive.

The present invention also refers to a paper machine for manufacturing paper from a pulp, the paper machine comprising at least one support body arrangement according to the invention.

Many additional benefits and advantages of the present invention will be readily understood by the skilled person in view of the detailed description below.

DRAWINGS

Figure 2:
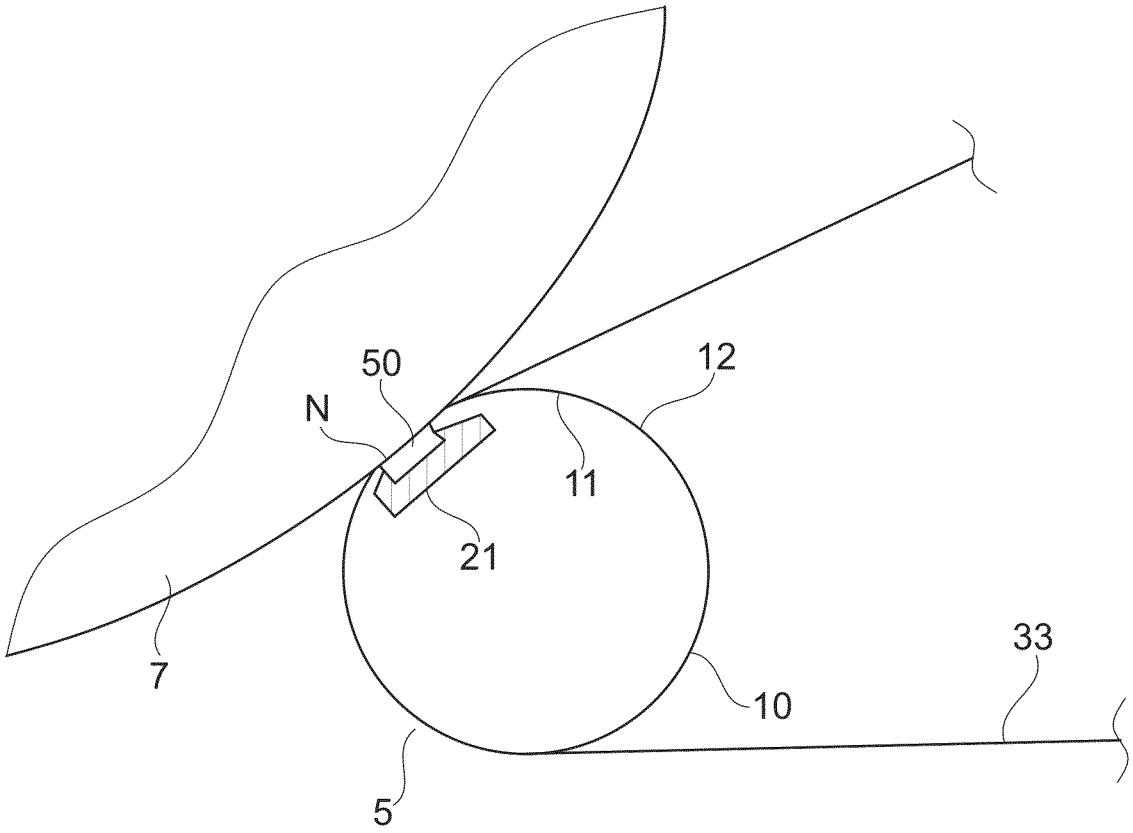
Figure 3:
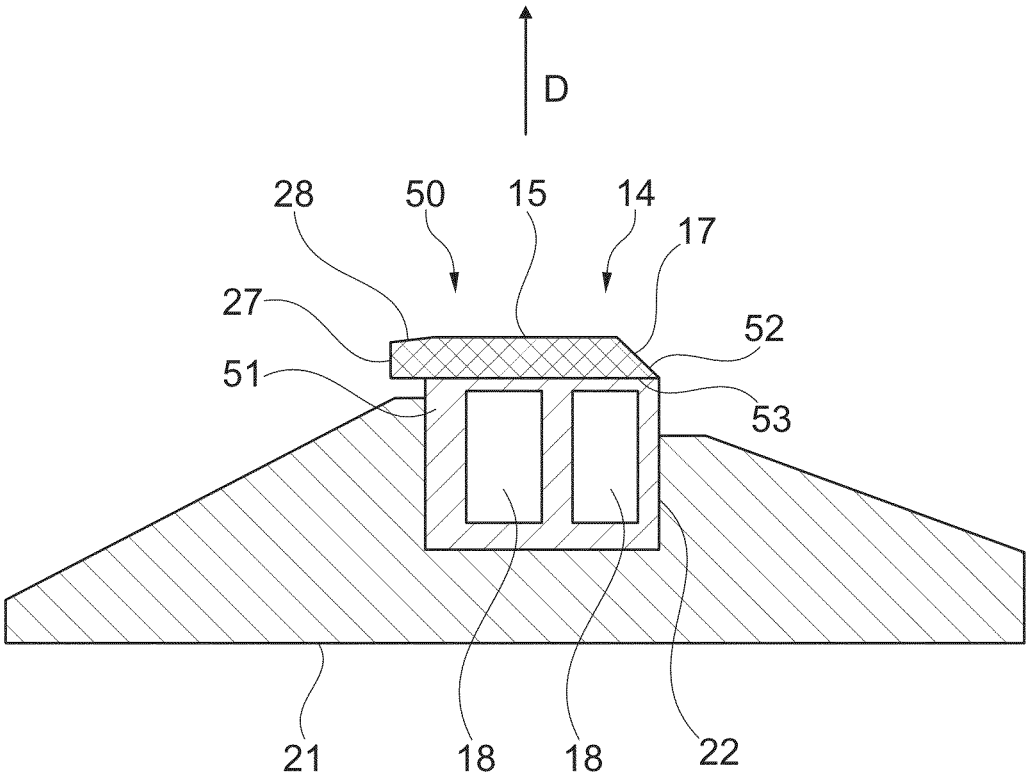
Figure 4A:
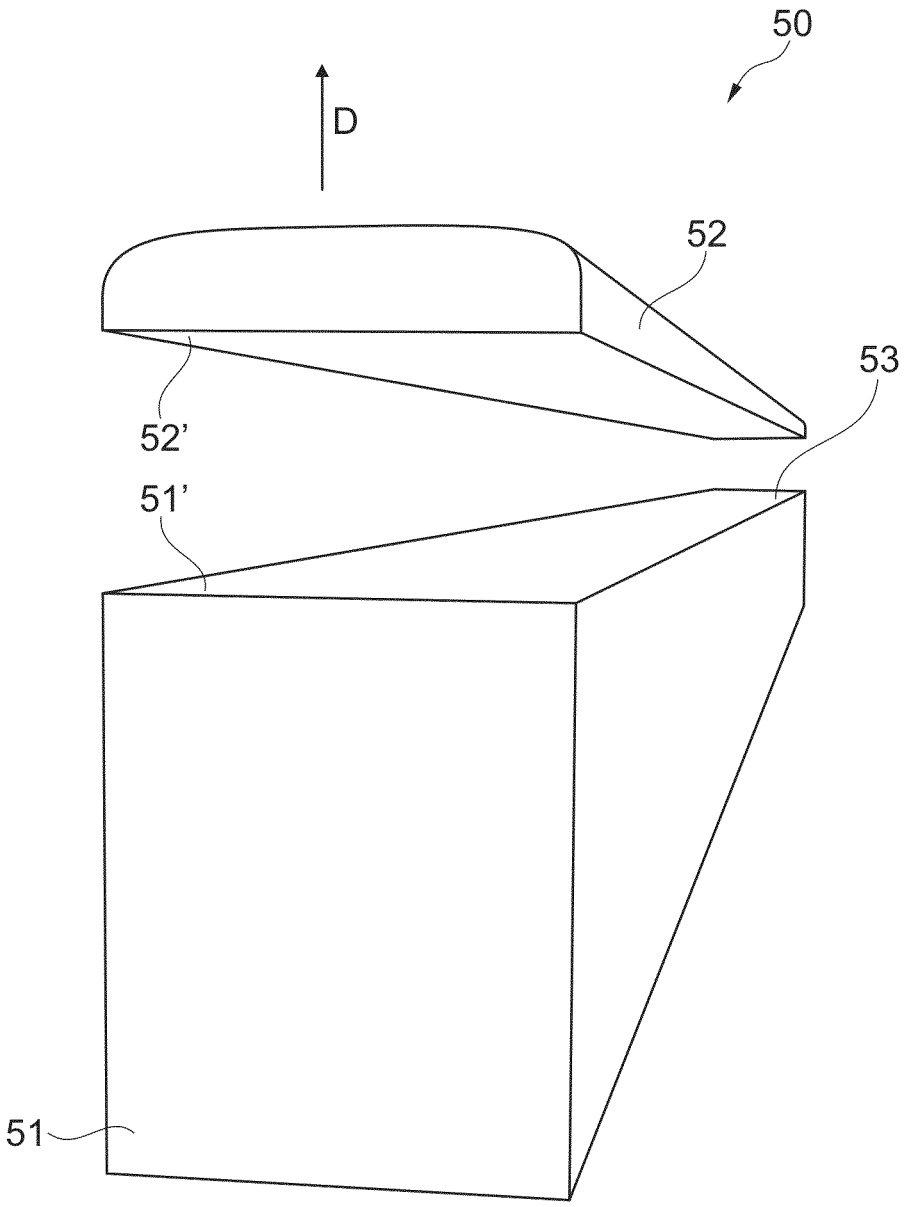
Figure 4B:
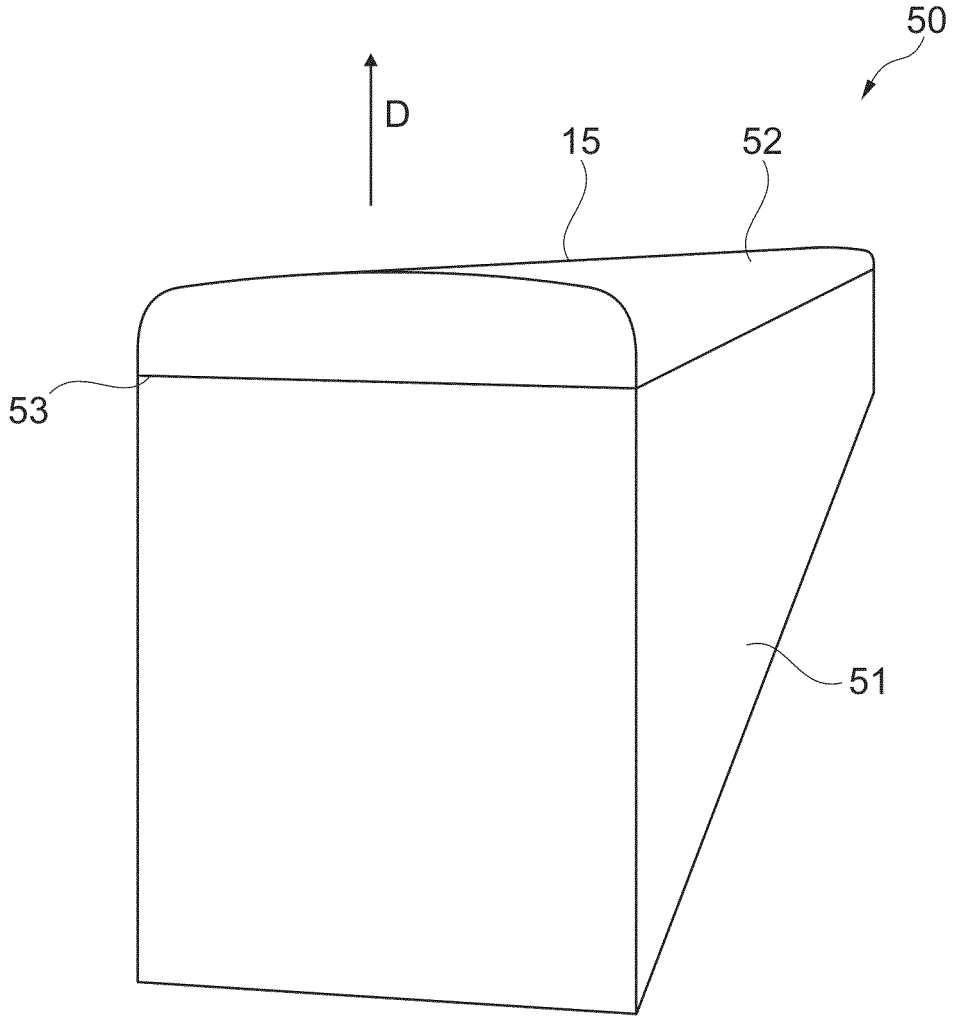
Figure 5A:
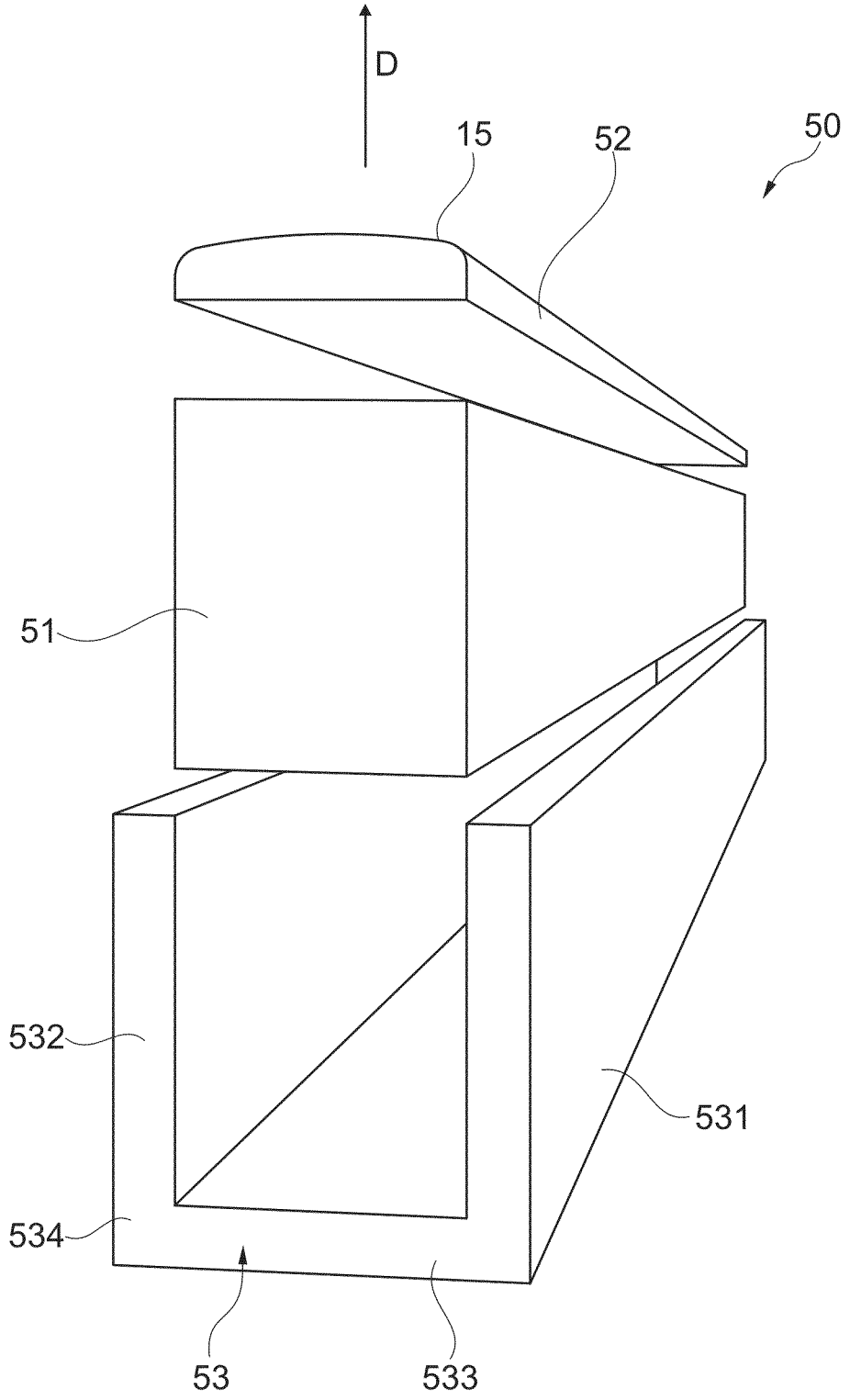
Figure 5B:
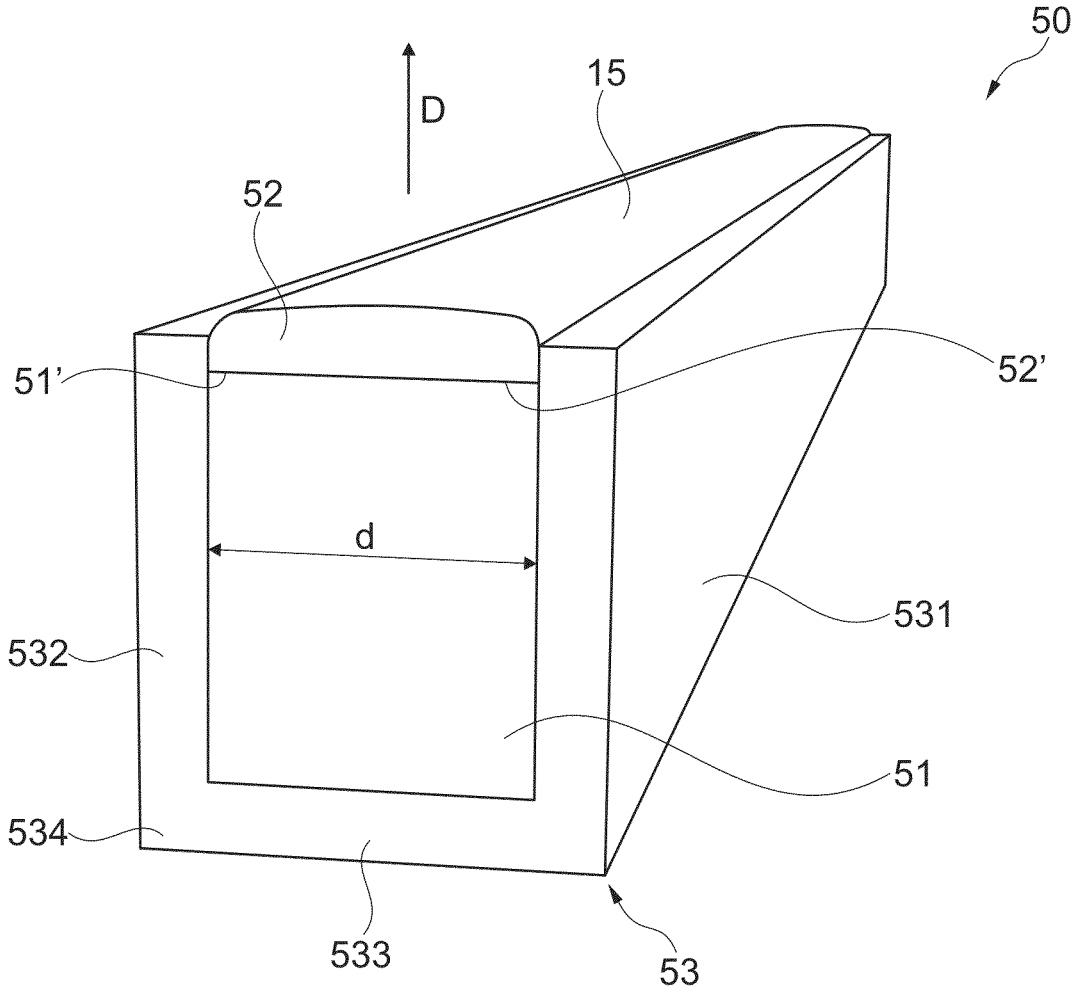
Figure 6A:
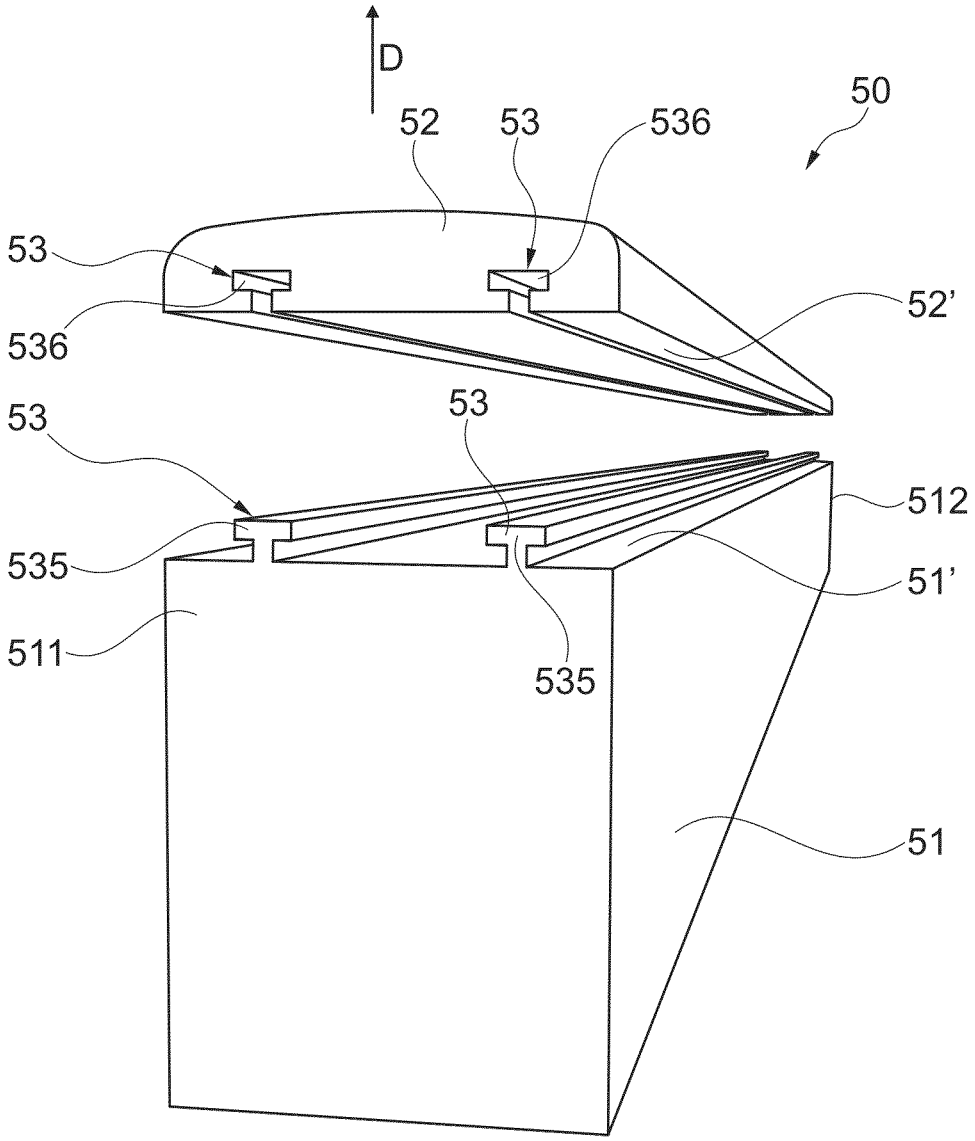
Figure 6B:
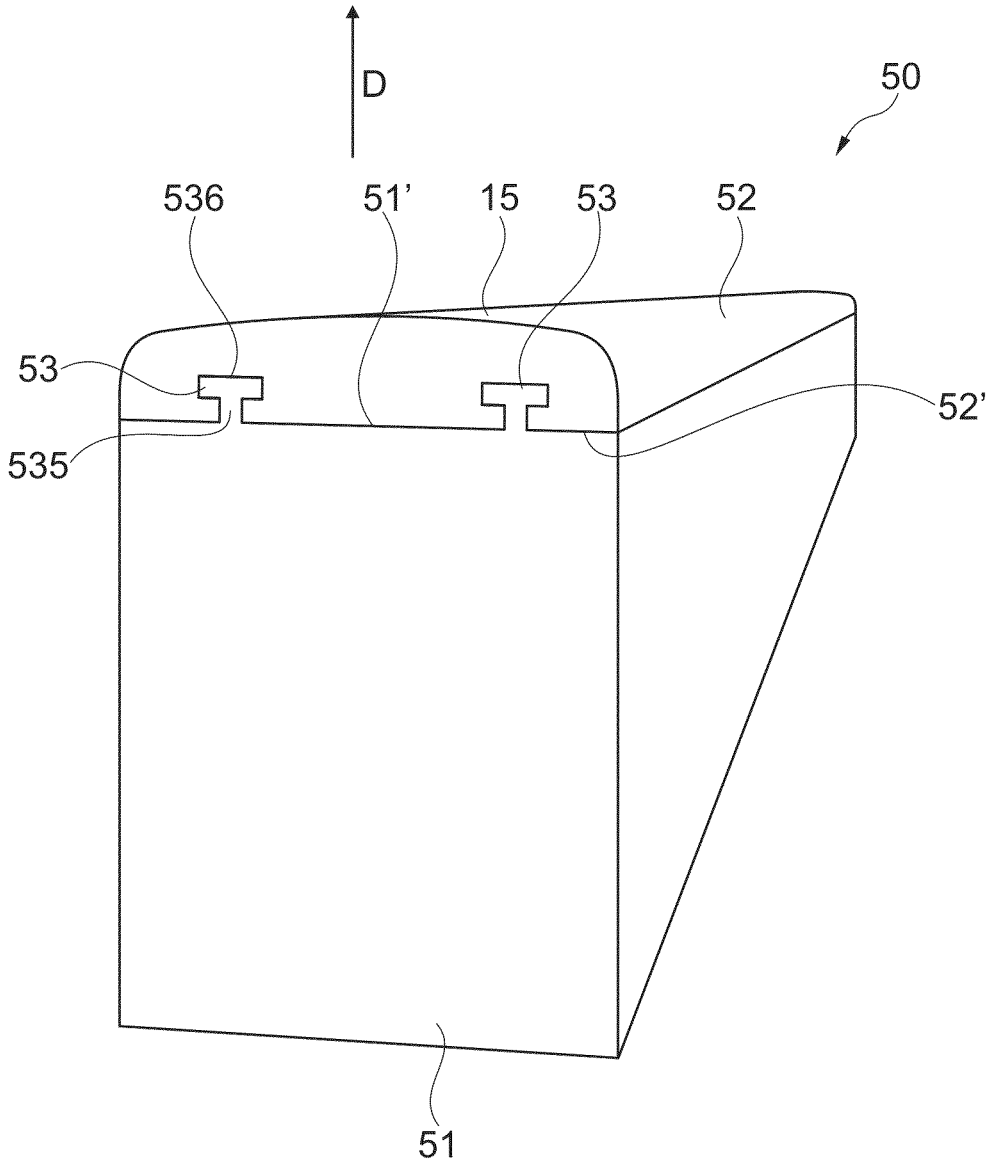
Figure 7:
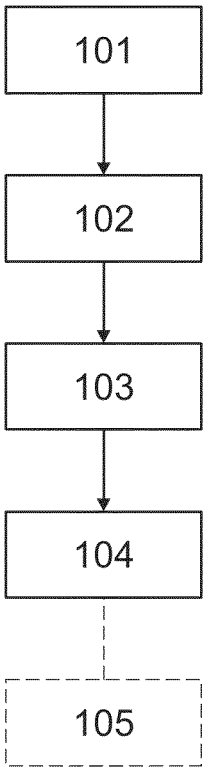
Figure 8:
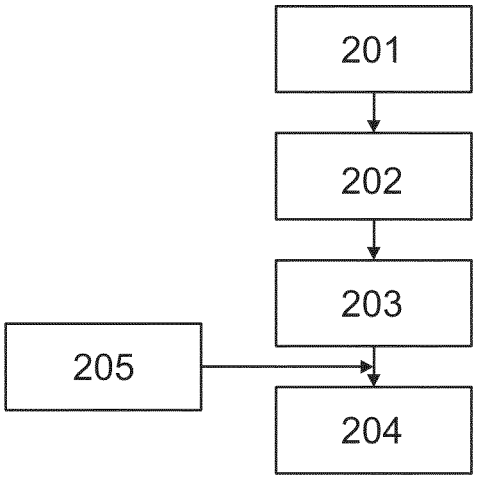

The invention will now be described in more detail with reference to the appended drawings, wherein FIG. 1 discloses schematically a paper machine comprising a support body arrangement according to the present invention;

FIG. 2 discloses a schematic cross-sectional view of an extended nip press of the paper machine of FIG. 1, in which the extended nip is formed between a support body and a counter-pressure member;

FIG. 3 discloses a cross-sectional view of the support body arrangement according to the invention placed in a support;

FIG. 4*a* discloses schematically a perspective view of a first embodiment of the invention;

FIG. 4*b* discloses schematically a perspective view of the first embodiment in a mounted state;

FIG. 5*a* discloses schematically a perspective view of a second embodiment of the invention;

FIG. 5*b* discloses schematically a perspective view of the second embodiment in a mounted state;

FIG. 6*a* discloses schematically a perspective view of a third embodiment of the invention;

FIG. 6*b* discloses schematically a perspective view of the third embodiment in a mounted state;

FIG. 7 discloses schematically the method of manufacturing the support body arrangement; and FIG. 8 discloses schematically the method of replacing the support body of the support body arrangement.

All the figures are schematic, not necessarily to scale, and generally only show parts which are necessary in order to elucidate the respective embodiments, whereas other parts may be omitted or merely suggested. Any reference number appearing in multiple drawings refers to the same object or feature throughout the drawings, unless otherwise indicated.

DETAILED DESCRIPTION

When referring to a "paper machine" herein, this is to be understood as a machine suitable for producing paper from a pulp. The machine may be configured to produce tissue paper but may alternatively be configured to produce writing paper or paperboard. In the following, references are made to the production of tissue paper but this is to be seen as an example only and not as limiting to the scope of the present invention.

When terms such as "upper", "lower", "top" and "bottom" are used in the following this is to be understood as being in relation to a first direction D that may be seen as a direction upwards. Thus, an upper side is a side that faces in the first direction D whereas a lower side faces in a direction opposite to the first direction D. Also, an upper part and a bottom part differ from each other in a movement towards the first direction D first passing the bottom part before passing the upper part.

When the terms "fixated" is used herein, or when it is described that a component is mounted or arranged so that movement in relation to another component is prevented, this is to be understood as that component being fastened or applied in such a way that independent movement of the component is prevented. Especially regarding a support body mounted on a base body, this means that the support body is reliably attached to the base body and that a movement of the base body is transferred to the support body.

FIG. 1 discloses schematically a paper machine 1 with a forming section 4 in which a head box 31 is arranged to inject stock in a gap between a forming fabric 32 and a felt 33. The forming fabric 32 would typically be a foraminous wire. The felt 33 is configured to pass over a forming roll 35 and the felt 33 and the forming fabric 32 are guided in loops by guide rolls 34. From the forming section 4, a newly formed wet fibrous web W is transported by the felt 33 to an extended press nip N formed between an extended nip roll 5 and a counter-pressure member 7. The extended nip roll 5 comprises a support body arrangement 50 according to the present invention as will be described in more detail further below. The counter-pressure member 7 may suitably be a Yankee drying cylinder but in some embodiments the extended nip may be arranged between the extended nip roll 5 and another counter-pressure member 7 before being passed to a Yankee drying cylinder.

In the press nip N between the extended nip roll and the counter-pressure member 7, water is pressed out of the web W and absorbed by the felt 33 which is water-receiving. The web W then passes over the Yankee drying cylinder 7 and is dried by heat propagated from the Yankee drying cylinder 7 to the web W. The Yankee drying cylinder 7 comprises internal heating symbolically identified as a heating device 8 but it is to be noted that various ways of heating a Yankee drying cylinder 7 are known, such as from within the Yankee drying cylinder or from an outside, and that each of the known ways of heating would be suitable for use with the paper machine 1 described herein. Suffice it to say that the Yankee drying cylinder 7 is typically heated to reach a temperature on a surface that contacts the web W of about 95-100° C. A dry solids content of the web W as it reaches the extended press nip N may vary considerably but is in typical applications in a range 18-30%. After the extended press nip N, the web W may have a dry solids content of 40-55%, depending on factors such as linear load in the nip, the temperature of the counter-pressure member 7 and the dry solids content of the web W before it reaches the extended press nip N.

The web W is typically doctored from the Yankee drying cylinder 7 by a doctor blade 9 and is passed in the form of a ready-dried web W to a reel-up 3.

What is said above is to be regarded as a general description of a paper machine 1, but it is especially to be noted that the support body arrangement according to the present invention may be used with various kinds of paper machines as long as they have the extended press nip between a support body and a counter-pressure member.

FIG. 2 discloses the extended press nip N formed between the extended nip roll 5 and the counter-pressure member 7 in more detail, showing the extended nip roll 5 to comprise a flexible jacket 10 with an interior surface 11 and an exterior surface 12. The flexible jacket 10 typically comprises polyurethane and is shaped as a tube that extends in a cross machine direction, said cross machine direction being a direction that is perpendicular to a machine direction defined as a direction from the forming section 4 to the reel-up 3, i.e. a main direction of travel of the web W.

Thus, the flexible jacket 10 has an axial direction that coincides with the cross machine direction and at its axial ends the flexible jacket 10 is normally connected to end walls that are rotatably arranged about and axis so that the extended nip roll 5 is able to rotate. Suitably, the extended nip roll 5 may be connected to a source of pressurized air so that an enclosed space formed by the flexible jacket 10 and the end walls may be filled with pressurized air.

Inside the extended nip roll 5, a support 21 is mounted and holds a support body arrangement 50 according to the present invention such that an upper surface 14 of the support body arrangement 50 is pressed against the interior surface 11 of the flexible jacket 10. On the upper surface 14 is a working surface 15 (see FIG. 3 onwards) that forms the extended press nip N by being pressed against the flexible jacket 10 so that the web W is in turn pressed against the counter-pressure member 7. The support body arrangement 50 is elongated and extends along the interior surface 11 of the extended nip roll 5 in a direction transversal to a direction of rotation of the extended nip roll 5 in order to be able to press against an entire width of the web W in the extended press nip N. For this purpose, the support body arrangement 50 suitably has a length that is equal to or larger than an intended width of the web W in order to achieve a desired pressure against the web W.

The working surface 15 is a surface that acts to form the extended press nip N. The shape of the working surface 15 may be adapted to form a desired press profile with the counter-pressure member 7, as is well known within the art. One prior art technology that deals with the design of a working surface is US 2009/0173465 (Metso paper).

FIG. 3 discloses the support 21 with the support body arrangement 50 according to the present invention held in place in a groove 22in a view from a cross machine direction. The support body arrangement 50 comprises a base body 51 and a support body 52 that are joined together by a mounting structure 53. The base body 51 comprises at least one pressure chamber 18 that is sealed and configured to be connected to a pressure source such that a supply of a pressurized fluid to the at least one pressure chamber 18 causes a controlled expansion of the at least one pressure chamber 18, leading to a controlled expanding of the base body 51 itself in a first direction D. The pressurized fluid may suitably be hydraulic fluid but in some embodiments other fluids may instead be used.

Suitably, the support 21 may be configured to cover the base body 51 on every side except on a side facing in the first direction D in order to ensure that the controlled expansion is directed in the first direction D only, but alternatively the base body 51 itself may be made such that expansion of the base body 51 in other directions are not possible. Since the support body 52 is mounted to extend from the base body 51 in the first direction D, an expansion of the base body 51 will result in the support body 52 being pushed in the first direction D and when the support body arrangement 50 is in place inside the extended nip roll 5 this results in the support body 52 being pressed against the interior surface 11 of the flexible jacket 10 so that the extended press nip N is formed. When the extended nip roll 5 is used, the extended press nip N is to be seen as being a closed nip when the working surface 15 of the support body arrangement 50 is pressed against the flexible jacket 10, i.e. when the at least one pressure chamber 18 is pressurized so that the base body 51 is expanded in the first direction D. When the base body 51 is not expanded, the extended press nip N is instead to be seen as being open.

It is to be noted that the at least one pressure chamber 18 may in some embodiments be provided underneath the base body 51 instead of inside the base body 51, as long as the at least one pressure chamber 18 is able to press against the base body 51 to achieve the extension in the first direction D.

In an extended press nip, a pressure profile should be unsymmetrical in such a way that a pressure peak is achieved shortly before an end of the press nip and so that pressure is significantly reduced immediately after the pressure peak. Such a pressure profile reduces re-wetting of the paper web W. It is also desirable that a pressure gradient at a beginning of the nip is relatively small such that the pressure is increased gently but with a larger gradient thereafter until the peak is reached towards the end of the press nip. Depending on properties of each application where an extended press nip is used, the upper surface 14 of the support body 52 may be adjusted to modify the pressure profile of the nip. In FIG. 3, an embodiment of the present invention is shown having the working surface 15 with an entry surface 28 and an exit surface 17 formed at either end of the working surface 15. When in use, a web W entering the extended nip is then subjected to pressure from the entry surface 28 first, followed by a middle part of the working surface 15 and ending with pressure from the exit surface 17. This achieves the desired pressure profile for the extended nip as described above. In the embodiment shown in FIG. 3, the entry surface 18 is provided on a lip 27 that extends from the support body 52. By adjusting the working surface 15 and especially its entry surface 28 and exit surface 17, the pressure profile may be adjusted. It is especially to be noted that the working surface 15 as shown in FIG. 3 is to be seen as an example only and that it is provided herein to illustrate the purpose of providing a working surface 15 to the extended nip press N. The main features of the present invention, however, lies in the support body arrangement 50 as such and the mounting of the support body arrangement 50 using the mounting structure 53 to join the base body 51 to the support body 52.

The support body arrangement 50 will now be described in more detail with reference to FIG. 4-6 showing a first, second and third embodiment of the support body arrangement 50. The embodiments differ mainly in the mounting structure 53 used and in the way the support body arrangement 50 is manufactured depending on the mounting structure 53. All embodiment of the invention are joined however by each comprising a base body 51 and a support body 52 that are mounted by the mounting structure 53 in order to allow an expansion of the base body 51 to be transmitted to the support body 52 and in preventing the support body 52 from coming loose from the base body 51. Thus, the mounting structure 53 is configured to form the support body arrangement 50 by engaging with the support body 52 and with the base body 51 so that they are fixated in relation to each other.

The word fixated is, as also mentioned above, to be understood as meaning a holding of the support body 52 and the base body 51 that prevents them from moving independently of each other. Thus, the support body 52 being fixated to the base body 51 means that the expansion of the base body 51 is transferred to the support body 52, while at the same time preventing such expansion of the base body or movement of the support body that results in a translational movement of one of them but not the other.

The various embodiments of the present invention also share the main advantages, namely the benefit of being able to manufacture the base body 51 and the support body 52 separately from each other and joining them together at a later time. This is a significant improvement over the prior art and allows for a simplified manufacturing of the support body arrangement 50 as well as a more versatile support body arrangement 50 that may be more easily modified to adapt to different applications and more cost efficient repair of support body arrangements 50 when in use.

Thus, FIG. 4*a* discloses the support body arrangement 50 of the first embodiment having the base body 51 and the support body 52. FIG. 4*b* discloses the same embodiment in a mounted state in which the support body 52 is mounted on the base body 51 to form the support body arrangement 50. The mounting arrangement 53 is in this embodiment and adhesive that is applied to an upper surface 51' of the base body 51 and/or a lower surface 52' of the support body 52. When the support body 52 is put in place on the base body 51, the adhesive of the mounting structure 53 causes the support body 52 and the base body 51 to adhere to each other to form the support body arrangement 50. Due to the adhesive, the expansion of the base body 51 is transferred to the support body 52 directly so that the working surface 15 is pushed in the first direction D.

Manufacture of the support body arrangement 50 of the first embodiment is performed by providing 101 the base body 51, providing 102 the support body 52 and providing 103 the mounting structure 53 by applying the adhesive of the mounting structure 53 to at least one of the upper surface 51' of the base body 51 and the lower surface 52' of the support body 52. The support body 52 is then mounted 104 on the base body 51 such that the upper surface 51' of the base body 51 is in contact with the lower surface 52' of the support body 52. Due to the adhesive of the mounting structure 53 being able to engage both with the lower surface 52' of the support body 52 and the upper surface 51' of the base body 51, the mounted state is formed with the support body 52 being fixated on the base body 51. In an optional step, the support body 52 may also be removed 105 from the support body arrangement 50 when desired.

FIG. 5*a* discloses a second embodiment of the support body arrangement 50 that differs from the first embodiment in the mounting structure 53 comprising at least two side portions 531, 532 that in the mounted state shown by FIG. 5*b* extend from the base body 51 in the first direction D at a distance d from each other. By the side portions 531, 532 extending in the first direction D beyond the upper surface 51' of the base body 51, the support body 52 is in the mounted state placed between the side portions 531, 532 so that the mounting structure 53 is able to fixate the support body 52 in relation to the base body 51. It is advantageous for the distance d to be approximately a width of the base body 51 and the support body 52 so that the support body 52 may be held in place by being blocked by the side portions 531, 532, although the support body 52 may also be more securely held by combining the mounting structure 53 with the side portions 531, 532 with the adhesive of the first embodiment so that an even more secure hold is achieved.

Suitably, the side portions 531, 532 are joined to each other at a bottom section 533 and form a side portion holder 534 such that the base body 51 and the support body 52 are placed inside the mounting structure 53 between the side portions 531, 532 in the mounted state with only an upper part of the support body 52 protruding beyond the side portions 531, 532 in the first direction D. Also, further side portions may be provided at ends of the base body 51 (not shown) so that the base body 51 may be inserted into the side portion holder 534 with only the upper surface 51' being visible. Alternatively, side portions may be provided on three sides of the base body 51 so that one side is left exposed. In embodiments where side portions are provided on four sides of the base body 51, conduits for supplying the pressurized medium may be provided in one of the side portions and be connected to the at least one pressure chamber 18 during mounting.

The side portion holder 534 may be integrated with the holder 21 shown in FIG. 1-2 or may replace that holder 21 so that only the side portion holder 534 is provided for securing the support body arrangement 50 inside the press roll 5 of the paper machine 1.

In an alternative embodiment, the mounting structure 53 may instead comprise a gripping member that is fixedly attached to the base body 51 and that is configured to grip or enclose at least a part of the support body 52 such that the support body 52 is mounted on the base body 51. The gripping member than fulfils the same function as the side portions 531, 532 in being able to hold the support body 52, and it may be realized through the gripping member being fastened on the base body 51 in a way similar to the side portions 531, 532 so that the support body 52 is fastened by the gripping member enclosing sides of the support body 52 and gripping them to hold the support body 52 in place.

For this embodiment in particular, the base body 51 may be very soft and flexible since it may be held in the holder so that expansion of the base body 51 in any direction other than the first direction D is efficiently prevented. The base body 51 may comprise an elastomer that has a shore A hardness of below 50 or even below 30 and may suitably comprise rubber. An expansion due to action of the pressure chambers 18 may thereby be transferred efficiently to the support body 52 mounted on the base body 51.

Manufacturing the support body arrangement 50 according to the second embodiment is performed by providing 101 the base body 51 and providing 102 the support body 52, and also by providing 103 the at least two side portions 531, 532 or alternatively the side portion holder 534 of the mounting structure 53. The base body 51 is then placed between the at least two side portions 531, 532 and the support body 52 is mounted 104 on the base body 51 such that it may be held in place by the at least two side portions 531, 532. The main feature of the side portions 531, 532 that enable them to hold the support body 52 in place is their extending from the base body 51 in the first direction D, such that the support body 52 will be unable to move in a direction in which a side portion 531, 532 is provided. In an optional step, the support body 52 may also be removed 105 from the support body arrangement 50 later, as desired.

In embodiments where only the two side portions 531, 532 are provided, these side portions 531, 532 may alternatively be mounted on the base body 51 such that they are fastened to the base body 51 or alternatively that they are integrated with the base body 51. In such embodiments, the base body 51 and the side portions 531, 532 of the mounting structure 53 may be provided as a single component. The support body 52 is then placed on the base body 51 so that the side portions 531, 532 hold the support body 52 fixated in relation to the base body 51 to form the mounted state.

If the adhesive is used, it may be applied to the base body 51 and/or the support body 52 before the base body 51 is placed between the side portions 531, 532 or alternatively the adhesive may be added when the base body 51 is in place between the side portions 531, 532 but before the support body 52 is added.

FIG. 6*a* discloses the third embodiment that differs from the first embodiment and the second embodiment in the mounting structure 53 comprising two portions that are configured to engage with each other in a mounted state shown in FIG. 6*b* in order to fixate the support body 52 in relation to the base body 51 to form the support body arrangement 50. This embodiment has many possible variations that will be described herein but that are similar in providing a first portion 536 that is fixed to the support body 52 and a second portion 535 that is fixed to the base body 51 so that the mounting mainly comprises bringing the first portion 536 and the second portion 535 into engagement with each other. In the third embodiment shown in FIG. 6*a*-6*b*, at least one of the first and second portion 536, 535 and suitably both are integrated with the support body 52 and the base body 51 but in other embodiments and in variations of this third embodiment the first and/or second portion 536, 535 are instead separate parts that are fixated to the support body 52 and/or the base body 51 during manufacture of the support body 52 and the base body 51, respectively, or that are fixated to the support body 52 and/or the base body 51 during manufacture of the support body arrangement 50 itself. That the first portion 536 and the second portion 535 are brought into engagement with each other is to be understood herein as the first portion 536 and the second portion 535 engaging with each other in such a way that they are fixed or fastened to each other. This encompasses both a releasable fastening and a permanent fastening, as described below with reference to various embodiments of the invention.

In the third embodiment of FIG. 6*a*, the first portion 536 is in the form of a keyway and the second portion 535 is in the form of a key fitting into the keyway. The keyway and the key may be made during manufacture of the support body 52 and of the base body 51, for instance through the support body 52 and/or the base body 51 being molded in a mold shaped to create the keyway or the key, but alternatively the keyway and/or the key may be created by cutting them from the base body 51 and support body 52, e.g. by machining. It is also possible to manufacture the keyway and the key through different processes and of course also at different sites and at different times as long as they are designed to fit each other so that they are able to engage. It is also possible that the keyway is integrated with the support body 52 whereas the second portion 535 comprising the key is instead a separate part that is attached to the base body 51. Also, the embodiment of FIG. 6*a* that shows a keyway in the support body 52 and a key on the base body 51 may of course be inversed so that the keyway is instead provided in the base body 51 and the key in the support body 52.

In the third embodiment shown by FIG. 6*a*, the second part 535 comprises a male part and the first part 536 comprises a female part such that the male part and the female part are configured to mate with each other in order to mount the support body 52 on the base body 51.

In another embodiment, one of the first portion 536 and the second portion 535 may instead comprise an inner thread and the other of the first portion 536 and the second portion 535 may comprise an outer thread that are configured to cooperate with each other such that the support body 52 on which the first portion 536 is fastened is able to be screwed into place on the base body 51 on which the second portion 535 is fastened.

Alternatively, one of the first portion 536 and the second portion 535 may comprises a pin and the other of the first portion 536 and the second portion 535 comprises a receiving opening configured to receive the pin such that the support body 52 may be mounted on the base body 51 by the pin being inserted into the receiving opening.

For each of the versions of the third embodiment it is to be noted that the support body 52 may be provided with a plurality of first portions 536 and the base body 51 may be provided with a plurality of second portions 535 and that manufacturing the support body arrangement 50 then comprises bringing each of the first portions 536 to interact with at least one of the second portions 535.

The manufacture of the support body arrangement 50 according to the third embodiment shown in FIG. 6*a*-6*b* comprises providing 101 the base body 51, providing 102 the support body 52 with the first portion 536 of the mounting structure 53 being fixedly attached to the support body 52 and the second portion 535 of the mounting structure 53 being fixedly attached to the base body 51. Thus, the mounting structure 53 is also provided 103. The first portion 536 and the second portion 535 are then brought into contact with each other so that they are able to engage in order to mount the support body 52 on the base body 51. For the keyway and the key shown in FIG. 6*a*-6*b* this suitably comprises sliding the support body 52 in place from one end 511 of the base body 51 to another end 512 such that the support body 52 is put in place to cover the base body 51 from one end 511 to the other 512. In this way, the support body 52 is mounted 104 on the base body 51. This forms the mounted state shown in FIG. 6*b*. In an optional step, the support body 52 may later be removed 105 from the base body 51, as desired.

The third embodiment and any variations on the third embodiment are also suitable for combination with the first embodiment, i.e. with providing an adhesive that further assists in fixating the support body 52 on the base body 51. Suitably, the adhesive may be applied to at least one of the first portion 536 and second portion 35 such that the first portion 536 and the second portion 535 are attached to each other by means on the adhesive during mounting.

In a fourth embodiment, the mounting structure 53 may be a separate mounting body that is placed between the base body 51 and the support body 52 during manufacture of the support body arrangement 50. The mounting structure 53 in this embodiment has a base body engagement part for engaging with the base body 51 and a support body engagement part for engaging with the support body 52. The base body engagement part and the support body engagement part may be of any of the types shown for the first portion 536 and the second portion 535.

One important benefit of the present invention is that the support body 52 may be releasably fixated to the base body 51 during mounting so that the support body 52 may be released again from the support body arrangement 50 at a later time. When providing the mounting structure 53 in the form of a male and female part, as inner and outer threads, or as keyway and key or pin and receiving opening, or variations thereof, this is most conveniently realized by the first portion 536 and second portion 535 being configured to disengage. This may take place by the threads being screwed in an opposite direction, by the pin being pulled out of the opening or by the male and female part being separated such as the key being slid out of the keyway for instance. This is especially advantageous in enabling the removal of the support body 52 as desired, such as when the support body 52 has been worn by pressing against the flexible jacket 10 of the nip roll 5 during operation of the paper machine 1. Since the profile of the working surface 15 is so important in achieving the desired extended nip, it is especially beneficial to be able to remove the support body 52 and replace it with a new unworn support body 52 if performance decreases. Also, depending on the paper machine 1 and the paper that is to be manufactured, it may be needed to change the pressure profile in the extended nip and this is most conveniently done by replacing only the support body 52 and using the same base body 51 to form a new support body arrangement 50. This is especially time saving since it allows for connections to the pressure chamber(s) 18 to remain in place, and in embodiments of the support body arrangement 50 where the support body 52 is easily removable such as variants of the third embodiment and the second embodiment, the downtime of the paper machine may be kept to a minimum.

The support body 52 of the support body arrangement 50 preferably comprises a first material that has a shore A hardness of 95 or less. This is advantageous in providing the extended press nip N to dewater the web W as desired. Examples of such material that are suitable for use in the support body 52 are polymers, suitably polyurethane or an elastomer such as rubber. In some embodiments, the support body 52 may comprise more than one material and it is advantageous that at least one of the materials has a shore A hardness of 95 or less.

Also, the base body 51 suitably comprises a second material that has shore A hardness of 90 or less. The second material is suitably elastically deformable and thus provides a base body 51 that is able to undergo the controlled expansion due to the expansion of the pressure chamber(s) 18. The second material may suitably be a polymer such as polyurethane or an elastomer such as rubber. The base body 51 may in some embodiments comprise a plurality of materials but may in other embodiments be made from only one material.

It is advantageous if the support body 52 is harder than the base body 51, i.e. if the support body 52 has a higher shore A hardness than a shore A hardness of the base body 51. This enables the base body 51 to expand as desired, while at the same time providing a more stable support body 52 that is able to provide a desired pressure profile in the extended nip. In some embodiments, the support body 52 may have a shore A hardness of 90-95 while the base body 51 has a shore A hardness of as low as 30-50. In other embodiments, the support body 52 and the base body 51 differ less from each other with regard to hardness of the materials.

When mentioning shore A hardness herein, this is to be understood as being according to ASTM D2240.

In some embodiments, the base body 51 and the support body 52 may comprise the same material. One material that is suitable for this is the aforementioned polyurethane that may be designed to have suitable properties for hardness.

In some embodiments of the present invention the base body 51 may be made from a plurality of parts, suitably a base section that comprises the at least one pressure chamber 18 and a top section that is arranged on the base section and faces in the first direction. In such embodiments, the top section may be releasably attached to the base section, but alternatively the top section may be joined to the base section in a permanent way so as to be non-removable. In yet other embodiments, the support body 52 may instead be made from a plurality of parts that are joined together in a releasable or permanent way.

The method for replacing the support body 52 of the support body arrangement 50 according to the invention will now be described. This is suitable in situations where a support body arrangement 50 is used in a paper machine 1 and has been subjected to wear or damage such that the extended press nip N no longer provides the desired pressure profile to the web W passing the nip. Also, the support body arrangement 50 may have been in use for its intended lifetime and is scheduled for exchanging the support body 52 in response to this.

Thus, the support body arrangement 50 according to any of the embodiments of the invention is provided in a paper machine 1. In most situations, the support body arrangement 50 would be removed from the paper machine 1 in a way that is well-known in the art before the support body 52 is replaced, but in some situations it is desirable for time and cost efficiency purposes to maintain the support body arrangement 50 in place during maintenance since the downtime of the paper machine 1 is shortened.

The method for replacing the support body 52 comprises removing 202 the support body 52 from the support body arrangement 50 by disengaging 201 it from the mounting arrangement 53 and/or from the base body 51 depending on which embodiment of the support body arrangement 50 is being used. The disengaging 201 of the support body 52 may thus comprise disengaging the first portion 536 and the second portion 535 or alternatively the removal of the support body 52 form the side portions 531, 532. It may also comprise removing or disengaging the adhesive so that the support body 52 is no longer fixed to the base body 51.

When the support body 52 is released, it is then removed 202 from the base body 51 and an additional support body 52 is provided 203. The additional support body 52 is then mounted 204 on the base body 51 by engaging with the mounting structure 53 in the same way that the support body 52 did or in a modified way such as adding an adhesive to the mounting structure 53 even if the mounting structure 53 previously lacked an adhesive.

The mounting structure 53 may be replaced 205 if it is not able to engage again, such as if the removal of the support body 52 has damaged the mounting structure 53 or if the mounting structure 53 is not designed to be able to be used more than once. If the mounting structure 53 comprised the adhesive before the support body 52 was removed, it is suitably replenished with fresh adhesive to be able to fixate the additional support body 52.

The adhesive may suitably be a polyurethane one-component moisture curing adhesive such as Liquisole/Rubberfix provided by Casco. However, many other types of adhesives may alternatively be used, as is well known to the skilled person.

The additional support body 52 may be identical to the support body 52 or may differ in some way, such as comprising different material in order to have different material properties such as elasticity, or may alternatively have a working surface 15 of a different profile. The additional support body 52 should be similar to the support body in being able to interact with the mounting structure 53, however, such that the additional support body 52 is able to be mounted on the base body 51.

It is to be noted that features from the various embodiments described herein may freely be combined, unless it is explicitly stated that such a combination would be unsuitable.

The invention claimed is:

1. A method for manufacturing a support body arrangement for a paper machine having an extended nip formed between the support body and a counter-pressure member, wherein the method comprises:

providing (101) a base body (51) comprising an upper surface (51') and at least one pressure chamber (18) that is configured to be pressurized for controlled expanding of the base body in a first direction (D), providing (102) a support body (52) comprising a lower surface (52') and a working surface (15) for forming an extended nip with a counter-pressure member, providing (103) a mounting structure (53) that is positioned on each of the upper and lower surfaces (51', 52') and that is located intermediate portions of the base and support body (51, 52) other than directly contacting upper and lower surfaces (51', 52') thereof, and mounting (104) the support body (52) on the base body (51) such that the upper and lower surfaces (51', 52') are in direct contact with one another by applying the mounting structure (53) so that movement of the support body (52) in relation to the base body (51) is prevented, wherein the support body (52) is mounted on the base body (51) so that the working surface (15) faces away from the base body (51).

2. The method according to claim 1, wherein the mounting structure (53) comprises an adhesive and wherein the mounting (104) of the support body (52) on the base body (51) comprises applying the adhesive to at least one of the base body (51) and the support body (52) and bringing the base body (51) and the support body (52) into contact with each other with the adhesive between them.

3. The method according to claim 1, wherein the mounting structure (53) comprises a first portion (536) that is fixedly attached to the support body (52) and a second portion (535) that is fixedly attached to the base body (51), and wherein further the mounting (104) of the support body (52) on the base body (51) comprises bringing the first portion (536) and the second portion (535) into engagement with each other for attaching the first portion (536) to the second portion (535).

4. The method according to claim 1, wherein the mounting structure (53) comprises at least two side portions (531, 532) that are configured to extend from the base body (51) in the first direction (D) at a distance (d) from each other, and wherein the mounting (104) of the support body (52) on the base body (51) comprises inserting the support body (52) between the at least two side portions (531, 532) to rest on the base body (51).

5. The method according to claim 1, wherein the mounting structure (53) comprises a separate mounting body with a base body engagement part and a support body engagement part, and wherein the mounting (104) of the support body (52) on the base body (51) comprises bringing the base body (51) into engagement with the base body engagement part and the support body (52) into engagement with the support body engagement part in order to fixate them in relation to each other.

6. The method according to claim 1, further comprising disengaging the mounting structure and removing (105) the support body (52) from the base body (51).

7. A support body arrangement for a paper machine having an extended nip formed between the support body arrangement and a counter-pressure member, wherein the support body arrangement comprises:

a base body (51) having an upper surface (51') and at least one pressure chamber (18) that is configured to be pressurized for controlled expanding of the base body (51) in a first direction (D), a support body (52) having a lower surface (52') and a working surface (15) for forming an extended nip with a counter-pressure member, wherein the support body (52) is arranged on the base body (51) so that the working surface (15) faces in the first direction (D) and the lower surface (52') directly contacts the upper surface (51'), and a mounting structure (53) that is positioned on each of the upper and lower surfaces (51', 52') such that the mounting structure (53) is located intermediate portions of the base and support body (51, 52) other than the directly contacting upper and lower surfaces (51', 52') thereof and configured to fixate the upper and lower surfaces (51', 52') of the support body (52) and the base body (51) in relation to each other.

8. A support body arrangement according to claim 7, wherein the mounting structure (53) comprises an adhesive arranged on the upper surface (51') of the base body (51) and on the lower surface (52') of the support body (52) such that the base body (51) and the support body (52) adhere to each other.

9. A support body arrangement according to claim 7, wherein the mounting structure (53) comprises a first portion (536) that is fixedly attached to the support body (52) and a second portion (535) that is fixedly attached to the base body (51), and wherein further the first portion (536) and the second portion (535) of the mounting structure (53) are configured to engage with each other by fastening the first portion (536) to the second portion (535) in a mounted state for mounting the support body (52) on the base body (51).

10. A support body arrangement according to claim 9, wherein the mounting structure (53) is configured to be releasably mounted such that the support body (52) can be removed from the base body (51).

11. A support body arrangement according to claim 9, wherein at least one of the first portion (536) is integrated with the lower surface (52') of the support body (52) or the second portion (535) is integrated with the upper surface (51') of the base body (51).

12. A support body arrangement according to claim 9, wherein one of the first portion (536) and the second portion (535) comprises a male part and the other of the first portion and the second portion comprises a female part, and wherein the male and female parts are configured to mate with each other such that the support body (52) is mounted on the base body (51).

13. A support body arrangement according to claim 9, wherein one of the first portion (536) and the second portion (535) comprises an inner thread and the other of the first portion and the second portion comprises an outer thread, and wherein the inner thread and outer thread are configured to cooperate such that the support body (52) is mounted on the base body (51).

14. A support body arrangement according to claim 9, wherein one of the first portion (536) and the second portion (535) comprises a pin and the other of the first portion (536) and the second portion (535) comprises a receiving opening for receiving the pin such that the support body (52) is mounted on the base body (51).

15. A support body arrangement according to claim 7, wherein the support body (52) comprises a first material, said first material being a material that has a shore A hardness 95 or less.

16. A support body arrangement according to claim 15, wherein the support body (52) and the base body (51) comprise different materials.

17. A support body arrangement according to claim 15, wherein the support body (52) and the base body (51) comprise the same material.

18. A support body arrangement according to claim 7, wherein the base body (51) has a shore A hardness of 90 or less.

19. A support body arrangement according to claim 7, wherein the support body (52) is harder than the base body (51).

20. A support body arrangement according to claim 7, wherein at least one of the support body (52) and the base body (51) comprise a polymer.

21. A support body arrangement for a paper machine having an extended nip formed between the support body arrangement and a counter-pressure member, wherein the support body arrangement comprises:

a base body (51) having a lower surface and at least one pressure chamber (18) that is configured to be pressurized for controlled expanding of the base body (51) in a first direction (D), a support body (52) having a working surface (15) for forming an extended nip with a counter-pressure member, wherein the support body (52) is arranged on the base body (51) so that the working surface (15) faces in the first direction (D), and a gripping member that is fixedly attached to the lower surface of the base body (51), the gripping member being configured to enclose at least a lower part of the support body (52) such that the support body (52) is mounted on the base body (51).

22. A support body arrangement according to claim 21, wherein the gripping member comprises at least two side portions that are configured to extend from the lower surface of the base body (51) in the first direction (D) at a distance from each other, and wherein the support body (52) is configured to be inserted between the at least two side portions such that the support body (52) is mounted on the base body (51).

23. A support body arrangement according to claim 21, wherein the support body (52) comprises a first material, said first material being a material that has a shore A hardness 95 or less.

24. A support body arrangement according to claim 23, wherein the support body (52) and the base body (51) comprise different materials.

25. A support body arrangement according to claim 21, wherein the base body (51) has a shore A hardness of 90 or less.

26. A support body arrangement according to claim 21, wherein the support body (52) is harder than the base body (51).

27. A support body arrangement according to claim 21, wherein at least one of the support body (52) or the base body (51) comprise a polymer.

* * * * *